US006685756B2

(12) United States Patent
Nevoret et al.

(10) Patent No.: US 6,685,756 B2
(45) Date of Patent: Feb. 3, 2004

(54) COATED ABRASIVES

(75) Inventors: Damien Cyrille Nevoret, Amherst, NY (US); Gwo Shin Swei, East Amherst, NY (US)

(73) Assignee: Saint-Gobain Abrasives Technology Company, Worcester, MA (US)

( * ) Notice: Subject to any disclaimer, the term of this patent is extended or adjusted under 35 U.S.C. 154(b) by 0 days.

(21) Appl. No.: 09/961,850

(22) Filed: Sep. 24, 2001

(65) Prior Publication Data

US 2003/0056443 A1 Mar. 27, 2003

(51) Int. Cl.[7] ..... B24D 3/00; B24D 3/28

(52) U.S. Cl. ..... 51/298; 51/309; 51/295; 51/307; 51/293; 451/28; 451/59

(58) Field of Search ..... 51/298, 307, 308, 51/309, 295, 297, 293; 451/28, 59

(56) References Cited

U.S. PATENT DOCUMENTS 5,370,718 A 12/1994 Terazawa et al.
5,833,724 A * 11/1998 Wei et al. ..... 51/307
5,876,268 A * 3/1999 Lamphere et al. ..... 451/41
5,910,471 A * 6/1999 Christianson et al. ..... 51/295
6,056,794 A 5/2000 Stoetzel et al.
6,110,015 A * 8/2000 Christianson et al. ..... 451/41
6,121,143 A 9/2000 Messner et al.
6,194,317 B1 * 2/2001 Kaisaki et al. ..... 438/692
6,287,184 B1 * 9/2001 Carpentier et al. ..... 451/526

FOREIGN PATENT DOCUMENTS

WO WO 98/03306 1/1998

* cited by examiner

*Primary Examiner*—Michael Marcheschi
(74) *Attorney, Agent, or Firm*—Joseph P. Sullivan

(57) ABSTRACT

A coated abrasive having an abrasive surface comprising a plurality of individual abrasive structures wherein the structures comprise a cured binder resin in an amount that is from 58 to 75% by volume of the volume of binder plus solid particles dispersed within the binder.

19 Claims, 6 Drawing Sheets

COATED ABRASIVES

BACKGROUND OF THE INVENTION

Figure 1:
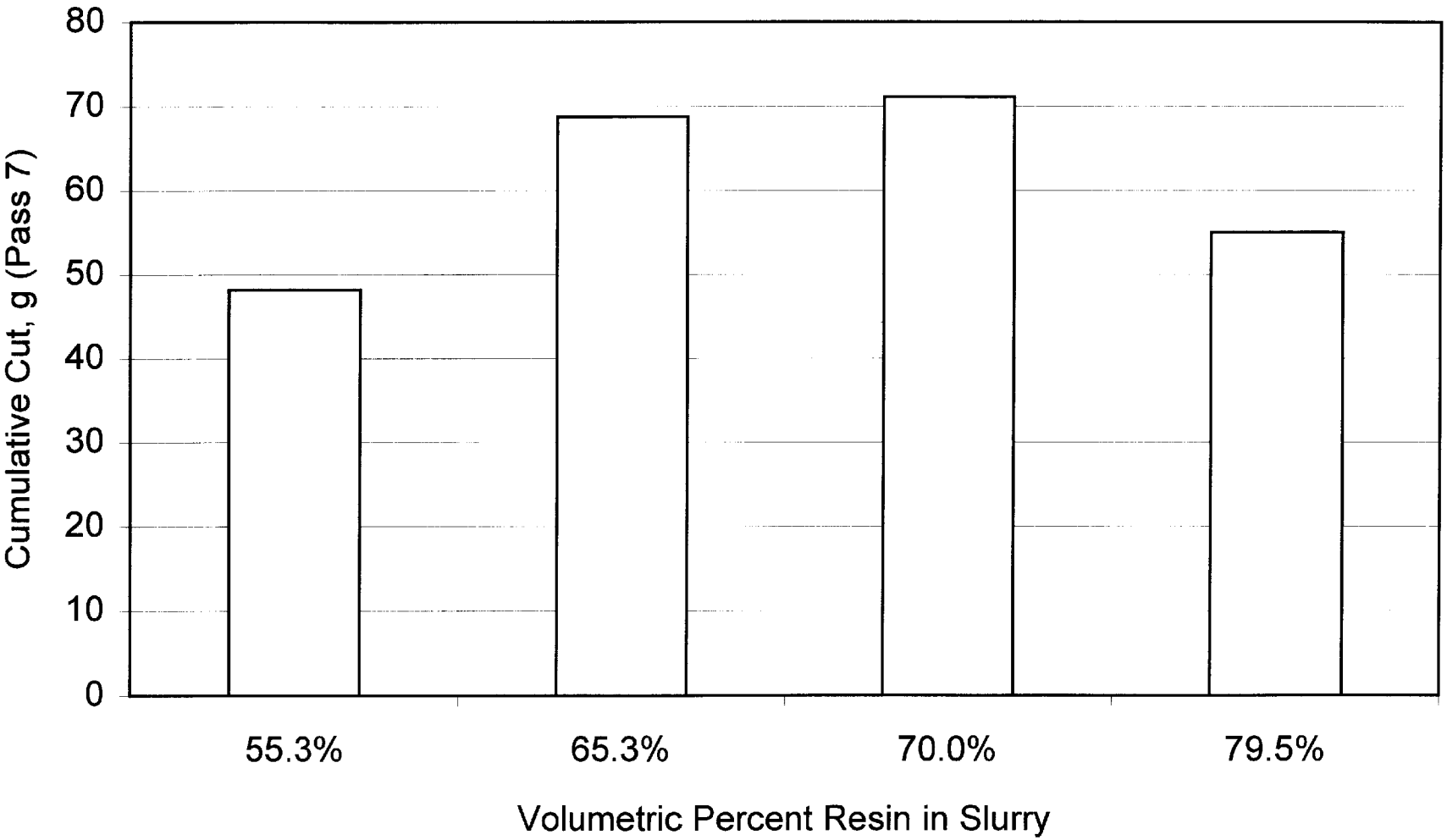

This invention relates to coated abrasives and more particularly to coated abrasives in which the abrasive surface comprises a plurality of generally regular composite structures each of which comprises abrasive grain dispersed within a cured binder. The shape, spacing, size and composition of the composites can be manipulated to achieve a wide range of abrasive properties and for this reason the products are frequently referred to as "engineered abrasives" and this convention is adopted herein.

However for certain applications, the performance of such engineered abrasives can be quite disappointing, falling short of the significant advantages realized in others. One such application is that obtained in wet grinding metals using relatively fine grit sizes. It has now been found possible to devise formulations that yield significantly improved results even though, from first principles, inferior results might be anticipated.

GENERAL DESCRIPTION OF THE INVENTION

The present invention provides a coated engineered abrasive having an engineered abrasive surface comprising a plurality of shaped abrasive structures adhered to a backing material wherein the structures comprise a cured formulation comprising an acrylate-based binder resin with abrasive particles uniformly dispersed in the binder wherein the proportion of resin in the formulation is from 58 to 75%, and preferably from 60 to 72%, and most preferably from 65 to 68% by volume.

The binder resin component of the formulation is understood to include the polymerizable components as well as any curing agents used to accelerate or promote cure and adhesion control additives. The remainder comprises the abrasive particles as well as any fillers used to adjust the rheology of the cured formulations, lubricants and any solid additives such as grinding aids and other property-modifying solid materials. Other components can also be present including a polymer in an amount up to 60% of the volume of the curable binder resin which serves to modify the physical properties of the formulation.

In conventional engineered abrasives developed for dry grinding applications, optimum performance is achieved when the abrasive structures comprise approximately 55% of cured resin component, 28% filler and about 17% abrasive grain, all proportions being by volume. This is considered the best for holding the maximum volume of abrasive particles for performing the abrasive function. It is considered intuitively that decreasing the volume proportion of abrasive in favor of the binder resin would decrease the effectiveness of the abrading action. It is however surprisingly found that this is not the case. The effectiveness in certain applications, including wet grinding (which is understood to mean grinding with the application of a liquid lubricant such as a water, or oil, based liquid lubricant) actually becomes more effective both in terms of the amount of material cut in a designated period or in terms of the finish remaining on the abraded surface after the abrading action. It is believed that the improvement may also be seen in applications such as in moderate to high pressure, dry applications such as weld blending and metallic surface pit removal.

The binder resin component for which this surprising effect is manifested is based on polymerizable acrylate monomers and this is understood to mean polymers based on polymerizable mono-acrylates, di-acrylates, tri-acrylates and other polyacrylates as well as mixtures thereof, optionally further comprising oligomers such as polyesters and urethanes copolymerizable with such acrylates and copolymerizable monomers that can be used to adjust the degree of cross-linking or rheology of the finished polymer.

It is also found that if a further polymeric component is added to the formulation the beneficial effect is maintained and may even be enhanced in that the most advantageous results appear to be obtained towards the upper end of the above specified range. This appears to be true whether the added polymer is a thermoplastic such as PVC or a thermosettable resin such as a phenolic resin. The amount of such polymer that may be added can be up to 100% of the volume of the binder resin but is preferably from 10 to 60% and preferably from 20 to 40% by volume of the binder resin volume.

The abrasive grits used can be any of those that have been described in the context of engineered abrasives including fused or ceramic alumina, alumina-zirconias, silicon carbide, cubic boron nitride, diamond, ceria, silicon nitride and mixtures thereof. In some cases very mild abrasives such as gamma alumina, boehmite, silica or ceria can be used alone or in admixture with one or more other abrasives. The abrasive particle sizes commonly used with engineered abrasives often are finer than those used in conventional abrasives such that, average particle sizes ranging from 1 to 200 micrometers and preferably from 5 to 100 micrometers can be used. With the finer grits the finish obtained is often as critical as the aggressiveness of the material removal. Here too the formulations of the present invention prove to be surprisingly effective in that smoother finishes are secured than with more conventional formulations.

The volume of abrasive grits in the formulation can be from 5 to 30% and preferably from 10 to 25%, based on the volume of the formulation. Where the formulation includes a mineral filler, the amount of such filler can be up to 40% and preferably from 5 to 30%, of the volume of the formulation.

The formation of the engineered abrasive surface can be by any of those techniques known in the art in which a slurry composite of abrasive and a binder precursor is cured while in contact with a backing and a production tool so as to be adhered on one surface to the backing and to have imposed on the other surface the precise shape of the inside surface of the production tool. Such a process is described for example in U.S. Pat. No. 5,152,917 issued on Oct. 6, 1992, to Pieper, et al.; U.S. Pat. No. 5,304,223 issued on Apr. 19, 1994, to Pieper, et al.; U.S. Pat. No. 5,378,251 issued on Jan. 3, 1995, to Culler, et al.; and U.S. Pat. No. 5,437,754 issued on Aug. 1, 1995, to Calhoun, all of which are incorporated herein by reference. Alternative formation methods, including rotogravure coating, are described in U.S. Pat. No. 5,840,088 issued on Nov. 24, 1998, to Yang, et al.; U.S. Pat. No. 5,014,468 issued on May 14, 1991, to Ravipati, et al.; and U.S. Pat. No. 4,773,920 issued on Sep. 27, 1988, to Chasman, et al., and embossing techniques as described in U.S. Pat. No. 5,833,724 issued on Nov. 10, 1998, to Wei, et al.; and U.S. Pat. No. 5,863,306 issued on Jan. 26, 1999, to Wei, et al., may be used and these too are incorporated by reference in this application.

DRAWINGS

FIGS. 1 to 6 are bar graph representations of the data presented in the Examples.

DESCRIPTION OF PREFERRED EMBODIMENTS

The invention is now particularly described with reference to specific formulations which are intended to illustrate the invention claimed herein. In the Examples the following ingredients were used:

Binder Resin . . . This refers to a 70/30 blend of TMPTA with EBECRYL® 3700

TMPTA . . . Trimethylolpropane triacrylate

EBECRYL® 3700 . . . An acrylated epoxy oligomer supplied by UCB Radcure Inc.

IRGACURE® 819 . . . A phosphine oxide-based photoinitiator available from Ciba Specialty Chemicals Corp.

A-1100 . . . A gamma-aminopropyltriethoxysilane coupling agent supplied by Crompton Corp. under the trademark SILQUEST® A1100.

Wollastonite . . . 325 mesh wollastonite supplied by Nyco Minerals Co.

EPL 320 . . . P320 grit brown alumina supplied by Treibacher.

FRPL P1000 . . . P1000 grit aluminum oxide supplied by Treibacher.

ATH . . . aluminum trihydrate supplied by Alcoa.

PVC . . . polyvinylchloride particles.

Varcum 29217 . . . powdered phenolic resole resin supplied by Occidental Chemical Corp.

In all the Examples the engineered abrasive was obtained using the procedure outlined in Example 1 of U.S. Pat. No. 5,833,724 issued on Nov. 10, 1998, to Wei, et al. The only variations were in the formulation deposited on the backing and embossed using the procedure described therein. This process involves application of a functional powder over the surface of the engineered abrasive to increase the viscosity of the surface layer and thereby inhibit flow before cure can be accomplished. The contribution of this functional powder to the proportions of the components is ignored since it is relatively quickly removed during use and is in any case a constant throughout the evaluations.

In the Examples the test method used a ACME single-head centerless grinder. In this machine a belt under test is backed by a rubber contact wheel and opposed by a rubber regulator wheel. In the tests two 1.5 inch (3.8 cm) bars of 304 stainless steel were passed through the machine with a gap set at 0.003 inch (0.0076 cm) less than the bar diameter. This counts as one pass and after each pass the gap was reduced by a further 0.003 inch (0.0076 cm). With the fine grit belts (P1000), the increments were reduced by 0.001 inc. (0.0025 cm) per pass. The test was continued until the belt was worn down to the backing. The test belt dimensions were 4 in.×54 in. (10.2 cm.×137.2 cm.) and the belt speed was 6000 SFPM (1830 SMPM). The belt was held under 40 lb gauge (18.2 kg) tension and the bar was fed into the gap at a speed of 57 in. (1.46 m) per minute. During grinding a water coolant containing a rust inhibitor was sprayed on the belt. The cut performance was measured as the total amount of metal worn away from the belt after seven passes for the belts made with P-320 grit abrasive and after 25 passes with the P1000 grit abrasive. The surface finish was measured for the finer grit products and the parameters selected were $R_z$ and $R_a$ each measured after the $25^{th}$ pass. $R_z$ is the average height difference between the highest five peaks and the lowest five valleys over a defined roughness profile, and $R_a$ is the average distance of all points in a roughness profile above and below the mean height of the profile.

EXAMPLE 1

This Example shows how the cut performance of the following formulations:

| COMPONENT | VOL % | VOL % | VOL % | VOL % |
|---|---|---|---|---|
| BINDER | 50.2 | 44.5 | 47.7 | 42.9 |
| ADDED EBECRYL 3700 | | 14.8 | 15.9 | 31.4 |
| A 1100 | 2.9 | 3.4 | 3.6 | 2.1 |
| IRGACURE 819 | 2.1 | 2.5 | 2.7 | 3.1 |
| TOTAL RESIN | 55.3 | 65.3 | 70.0 | 79.5 |
| EPL P320 | 12.0 | 9.5 | 10.0 | 7.9 |
| WOLLASTONITE | 32.8 | 26.3 | 20.0 | |
| ATH | | | | 12.6 |
| TOTAL SOLIDS | 44.8 | 34.8 | 30.0 | 20.5 |

As will be seen from FIG. 1, the cumulative cut is greatest for the formulations containing 65.3 and 70% by volume of the resin binder. Greater and smaller volumes led to inferior cumulative cut performance.

In the Examples the proportions of EBECRYL 3700, (which is characterized by a higher viscosity than the "Binder" formulation), added as well as the amounts of filler incorporated were determined with a view to maintaining a consistent rheology suitable for the embossing technique used to create the engineered abrasive surface.

EXAMPLE 2

This Example illustrates the effect of adding a PVC resin to the formulation. Two runs were carried out, one with a PVC addition and an increased volume ratio, (with respect to the abrasive), and the other using a typical optimized formulation intended for dry grinding applications. The belts evaluated were made using formulations with the following compositions.

| COMPONENT | VOLUME % | VOLUME % |
|---|---|---|
| BINDER | 50.2 | 48.9 |
| IRGACURE 819 | 2.1 | 2.1 |
| PVC | | 25.9 |
| A1100 | 2.9 | 2.1 |
| TOTAL RESIN (w/o PVC) | 55.3 | 71.6 |
| EPL P320 | 12.0 | 8.1 |
| WOLLASTONITE | 32.8 | |
| ATH | | 12.9 |
| TOTAL SOLIDS | 44.8 | 21.0 |

Figure 2:
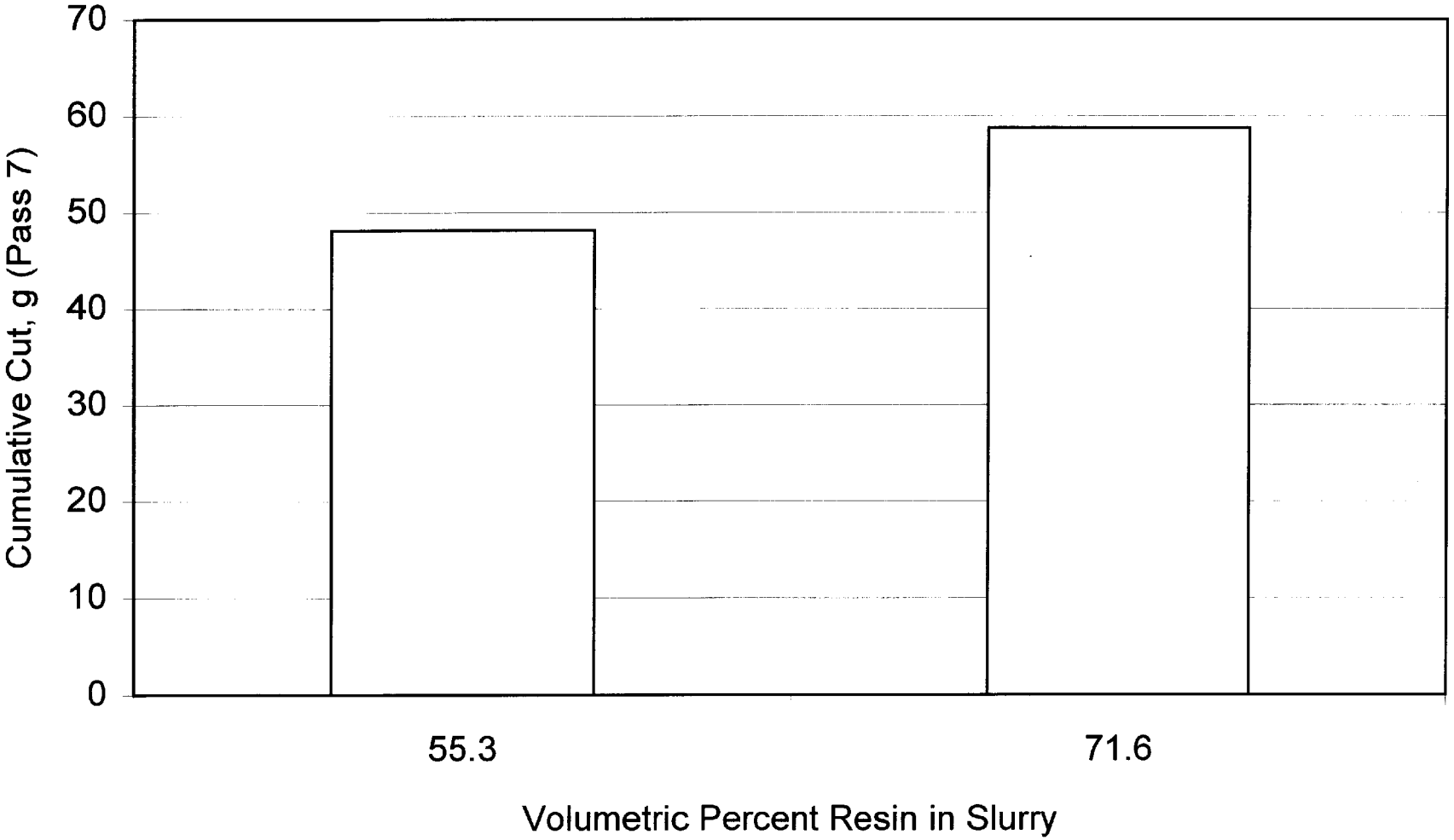

As will be appreciated from comparison of the above formulations with the bar graph shown as FIG. 2, the formulation with reduced abrasive content and a higher binder content that also incorporated PVC was very significantly superior.

EXAMPLE 3

This Example illustrates the effect of adding a phenolic resin to the formulation in addition to raising the volume percentage of the acrylate binder resin in the formulation minus the phenolic resin. The formulations used to make abrasive belts for the evaluations are shown in the following Table.

| COMPONENT | VOLUME % | VOLUME % | VOLUME % |
|---|---|---|---|
| BINDER | 50.2 | 52.7 | 45.5 |
| IRGACURE 819 | 2.1 | 2.2 | 1.9 |
| VARCUM 29-215 | | 22.7 | 45.5 |
| A1100 | 2.9 | 2.1 | 1.7 |
| TOTAL RESIN (w/o VARCUM) | 55.3 | 73.7 | 89.9 |
| EPL P320 | 12.0 | 7.8 | 2.1 |
| WOLLASTONITE | 32.8 | | |
| ATH | | 12.5 | 3.4 |
| TOTAL SOLIDS | 44.8 | 20.3 | 5.5 |

Figure 3:
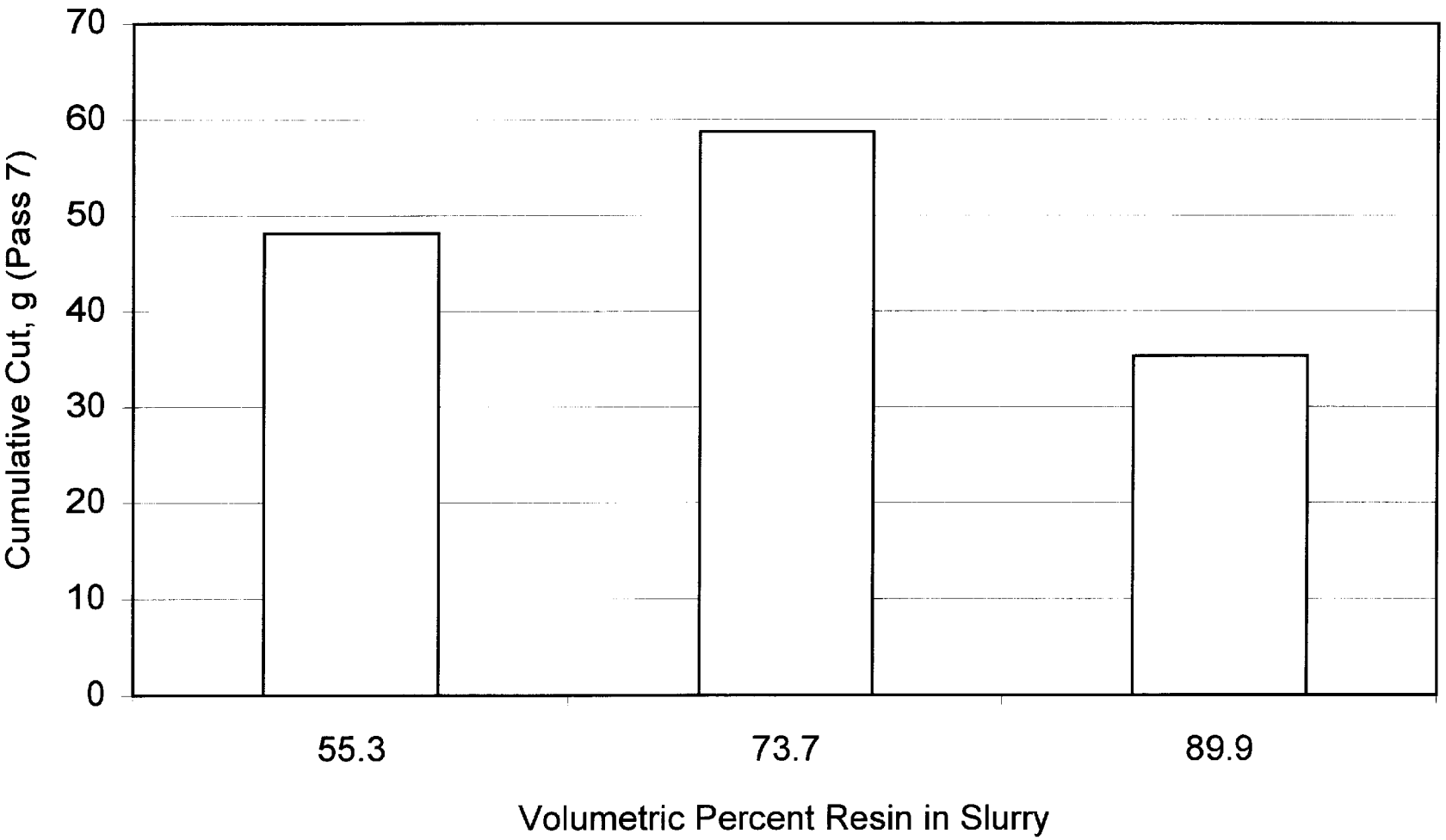

From the graph shown as FIG. 3, which represents the cumulative cut data obtained from evaluating belts made using the above formulations, it is clear that even with an amount of phenolic resin equivalent to about 30% of the total binder resin composition, the performance of the formulations according to the invention is superior to that of belts made with more or less than the preferred range of resin binder.

The above Examples were illustrative of the advantages offered by belts made using various formulations in which the abrasive particles had a grit size of P320 which corresponds to an average size of 45 microns. In the next group the abrasive particles have an average grit size of P1000 or about 16 micrometers. In these products the surface finish that is left after abrading is as important as the metal removal rate.

EXAMPLE 4

In this Example the following formulations were used to prepare coated abrasives with engineered surfaces. The cut rate was measured for each using the same technique and equipment described above and the results are shown in FIG. 4.

| COMPONENT | VOLUME % | VOLUME % | VOLUME % |
|---|---|---|---|
| BINDER | 18.2 | 24.2 | 42.9 |
| TMPTA | 36.4 | 33.9 | 18.4 |
| IRGACURE 819 | 2.3 | 2.5 | 2.6 |
| A-1100 | 3.1 | 3.3 | 3.5 |
| TOTAL RESIN | 60.0 | 64.0 | 67.5 |
| WOLLASTONITE | 35.0 | 16.0 | 18.0 |
| FPRL-P1000 | 5.0 | 20.0 | 14.5 |
| TOTAL SOLIDS | 40.0 | 36.0 | 32.5 |

Figure 4:
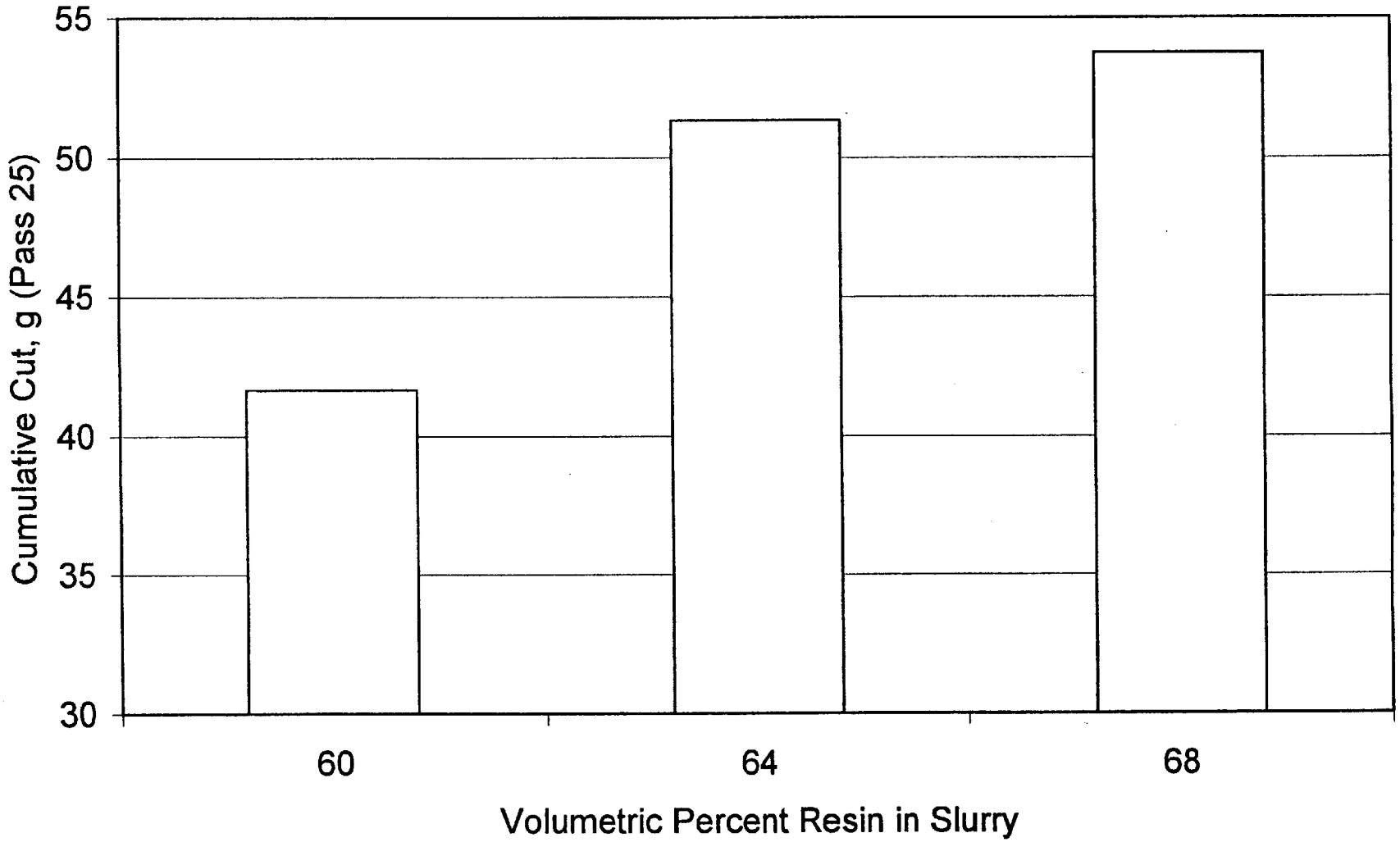

The data shown in FIG. 4 show clearly that the same pattern of advantage in terms of cumulative cut is to be found with products made using much smaller grit sizes

EXAMPLE 5

This Example evaluates products similar to those studied in Example 4. This time however the focus of evaluation is on the finish left behind after 25 passes. The formulations evaluated were as shown in the following Table.

| COMPONENT | VOL. % | VOL. % | VOL. % | VOL. % |
|---|---|---|---|---|
| BINDER | 17.6 | 24.2 | 42.9 | 53.4 |
| TMPTA | 35.2 | 33.9 | 18.4 | 10.7 |
| IRGACURE 819 | 2.2 | 2.5 | 2.6 | 2.7 |
| A-1100 | 3.0 | 3.3 | 3.5 | 3.7 |
| TOTAL RESIN | 58.0 | 64.0 | 67.5 | 70.5 |
| WOLLASTONITE | 22.0 | 16.0 | 18.0 | 16.0 |
| FPRL-P1000 | 20.0 | 20.0 | 14.5 | 13.5 |
| TOTAL SOLIDS | 42.0 | 36.0 | 32.5 | 29.5 |

Figure 5:
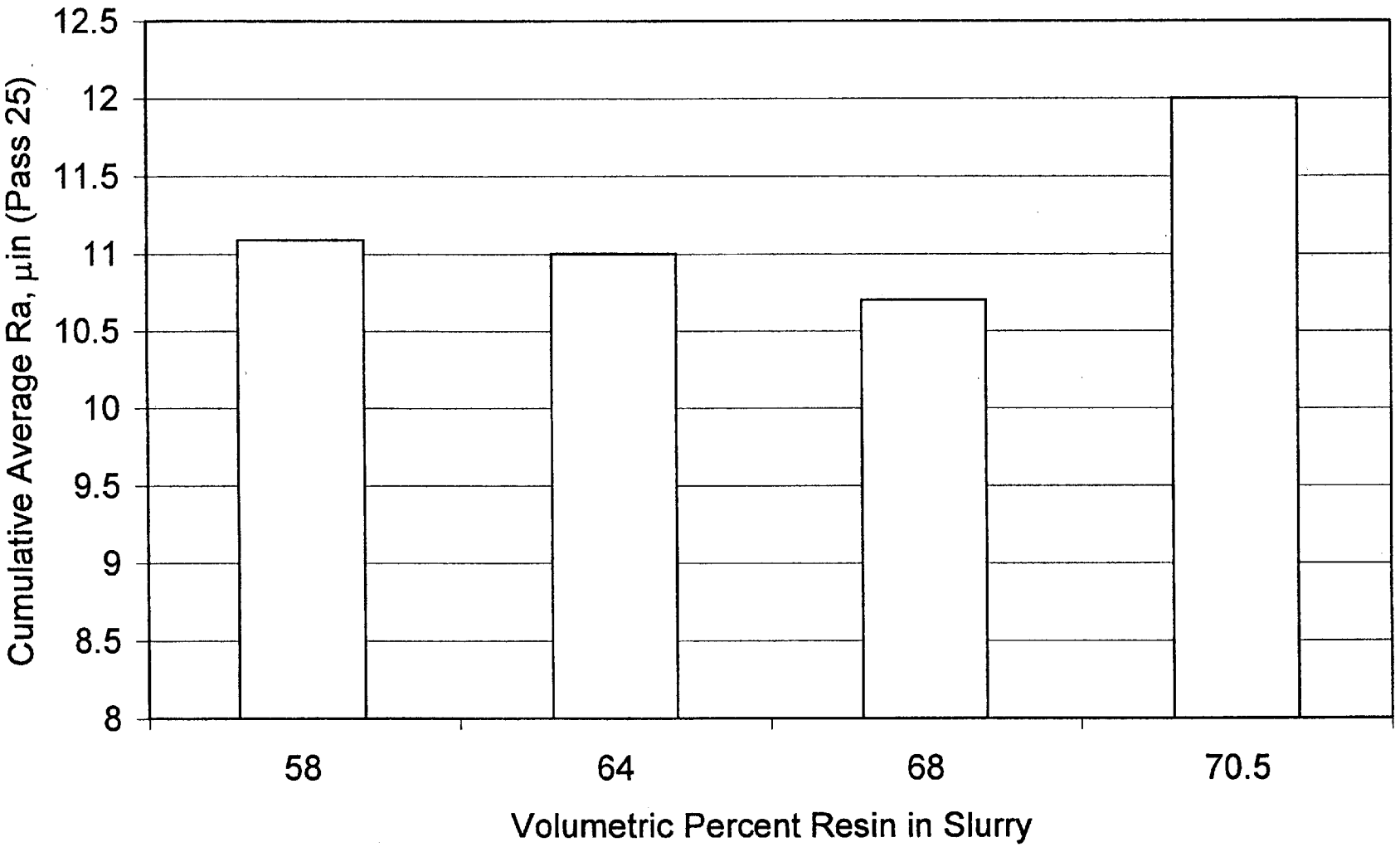
Figure 6:
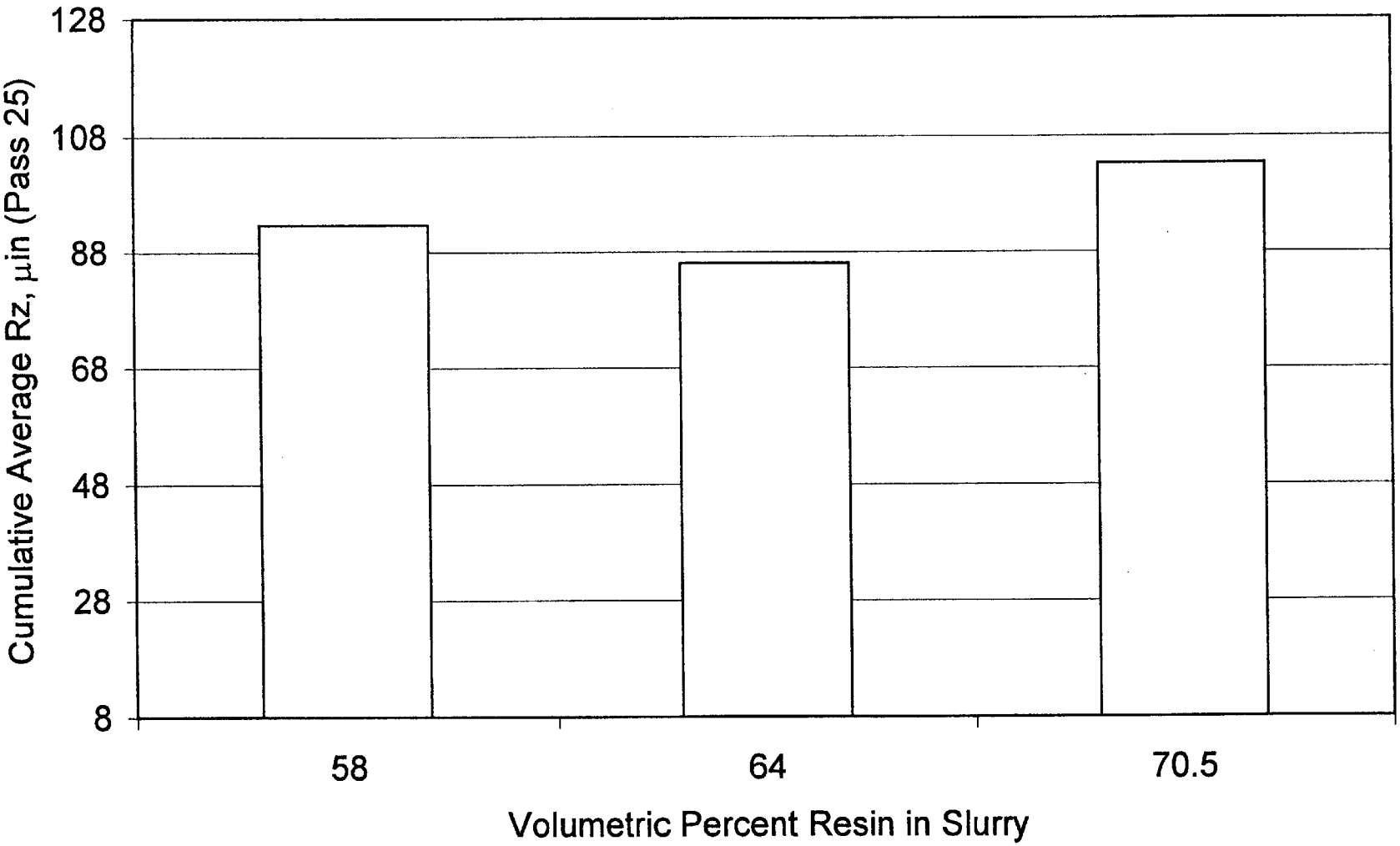

FIGS. 5 and 6 show the $R_a$ and $R_z$ values for the surfaces ground using belts made using the first, second and fourth of the above formulations and the $R_z$ value for a surface ground using a belt made using the third is also given. From these it can be seen that the surface finish is only modestly affected and is actually slightly better over at least part of the range.

What is claimed is:

1. A method for abrading a metal surface of an object comprising:

abrading the metal surface of the object using a centerless grinding apparatus, the centerless grinding apparatus comprising a coated abrasive having an engineered surface comprising a plurality of shaped abrasive structures adhered to a backing material wherein the structures comprise a cured formulation comprising a binder resin based on polymerizable acrylate monomers with abrasive particles uniformly dispersed in the binder resin wherein the proportion of binder resin in the formulation is 58 to 75% by volume.

2. The method of claim 1 wherein the proportion of binder resin in the formulation is 60 to 72% by volume.

3. The method of claim 1 wherein the binder resin based on polymerizable acrylate monomers includes a compound selected from the group consisting of mono-acrylates, di-acrylates, tri-acrylates, and mixtures thereof.

4. The method of claim 1 wherein the formulation further includes 10 to 60% by volume, based on the volume of the binder resin component, of a polymer filler.

5. The method of claim 1 wherein the formulation further includes 5 to 30% by volume of a mineral filler.

6. The method of claim 1 wherein the formulation includes 5 to 20% by volume of abrasive particles.

7. The method of claim 1 wherein the abrasive particles have an average particle size of 1 to 200 micrometers.

8. The method of claim 7 wherein the abrasive particles have an average particle size of 5 to 100 micrometers.

9. The method of claim 1 the centerless grinding apparatus is a centerless belt grinding apparatus.

10. The method of claim 1 wherein the metal surface of the object is abraded in the presence of a grinding liquid.

11. The method of claim 1 wherein the metal surface of the object is stainless steel.

12. A method for centerless grinding of a metal surface of a workpiece comprising:

(a) supporting the workpiece between a regulating wheel and a portion of an abrasive belt backed by a contact wheel; and (b) contacting the workpiece with the abrasive belt, thereby grinding the metal surface of the workpiece;

wherein the abrasive belt comprises a coated abrasive having an engineered surface comprising a plurality of shaped abrasive structures adhered to a backing material wherein the structures comprise a cured formulation comprising a binder resin based on polymerizable acrylate monomers with abrasive particles uniformly dispersed in the binder wherein the proportion of binder resin in the formulation is 58 to 75% by volume.

13. The method of claim 12 further including the step of applying a grinding liquid to the surface of the abrasive belt during grinding.

14. The method of claim 13 wherein the grinding liquid includes water.

15. The method of claim 12 wherein the proportion of binder resin in the formulation is 60 to 72% by volume.

16. The method of claim 12 wherein the binder resin based on polymerizable acrylate monomers comprises a polymer based on a compound selected from the group consisting of mono-acrylates, di-acrylates, tri-acrylates, and mixtures thereof.

17. The method of claim 12 wherein the abrasive particles have an average particle size of 5 to 100 micrometers.

18. The method of claim 12 wherein the metal surface of the workpiece is stainless steel.

19. A centerless grinding belt comprising:

(a) a backing material having a first portion and a second portion wherein the first portion is joined to the second portion to form a centerless grinding belt; and (b) an engineered surface comprising a plurality of shaped abrasive structures adhered to the backing material wherein the structures comprise a cured formulation comprising a binder resin based on polymerizable acrylate monomers with abrasive particles uniformly dispersed in the binder resin wherein the proportion of binder resin in the formulation is 58 to 75% by volume.

* * * * *